US012735153B2

(12) United States Patent
Mikhelson et al.

(10) Patent No.: US 12,735,153 B2
(45) Date of Patent: Sep. 15, 2026

(54) INTEGRATED PRODUCTION COMPLEX ON A GRAVITY- BASED STRUCTURE (GBS)

(71) Applicant: Publichnoe Aktsionernoe Obshchestvo "NOVATEK", Tarko-Sale (RU)

(72) Inventors: Leonid Viktorovich Mikhelson, Moscow (RU); Valeriy Nikolaevich Retivov, Moscow (RU); Sergey Gennadyevich Solovyev, Novyy Urengoy (RU)

(73) Assignee: Publichnoe Aktsionernoe Obshchestvo "NOVATEK", Tarko-Sale (RU)

( * ) Notice: Subject to any disclaimer, the term of this patent is extended or adjusted under 35 U.S.C. 154(b) by 302 days.

(21) Appl. No.: 18/697,526

(22) PCT Filed: Sep. 22, 2022

(86) PCT No.: PCT/RU2022/000287
§ 371 (c)(1),
(2) Date: Apr. 1, 2024

(87) PCT Pub. No.: WO2023/063848
PCT Pub. Date: Apr. 20, 2023

(65) Prior Publication Data

US 2024/0409193 A1 Dec. 12, 2024

(30) Foreign Application Priority Data

Oct. 11, 2021 (RU) ..... 2021129508

(51) Int. Cl.
*B63B 35/44* (2006.01)

(52) U.S. Cl.
CPC ..... *B63B 35/44* (2013.01); *B63B 2035/448* (2013.01)

(58) Field of Classification Search
CPC ..... B63B 35/00; B63B 35/44; B63B 77/00; E02B 17/00; E02B 17/02; E02D 27/00; E02D 27/52; F25J 1/00; F17C 1/00
(Continued)

(56) References Cited

U.S. PATENT DOCUMENTS 3,766,583 A * 10/1973 Phelps ..... B63B 35/4413 114/264
10,590,618 B2 * 3/2020 Kjersem ..... E02B 17/02
(Continued)

FOREIGN PATENT DOCUMENTS

CA 3 150 322 A1 6/2021
FR 2 894 646 A1 2/2008
(Continued)

OTHER PUBLICATIONS

International Search Report in PCT/RU2022/000287, mailed Jan. 19, 2023.

*Primary Examiner* — Lars A Olson
(74) *Attorney, Agent, or Firm* — Collard & Roe, P.C.

(57) ABSTRACT

An integrated production complex includes a gravity-based structure (GBS) accommodating topside modules with process equipment. The GBS has rectangular top and base slabs, an intermediate horizontal slab, internal vertical walls, at least one compartment with a tank to store hydrocarbons and/or respective processed products, and ballast compartments. The top slab has supports, on which the topside modules are installed. The GBS has a rectangular prism central part including the top slab, and a protruding part disposed along the sides of the central part around its entire perimeter and having external vertical walls. Protruding and central parts share the base slab, with the protruding part height less than the central part. The central part has longitudinal and transverse walls forming compartments for tanks and ballast compartments. The protruding part has internal
(Continued)

Figure 1:
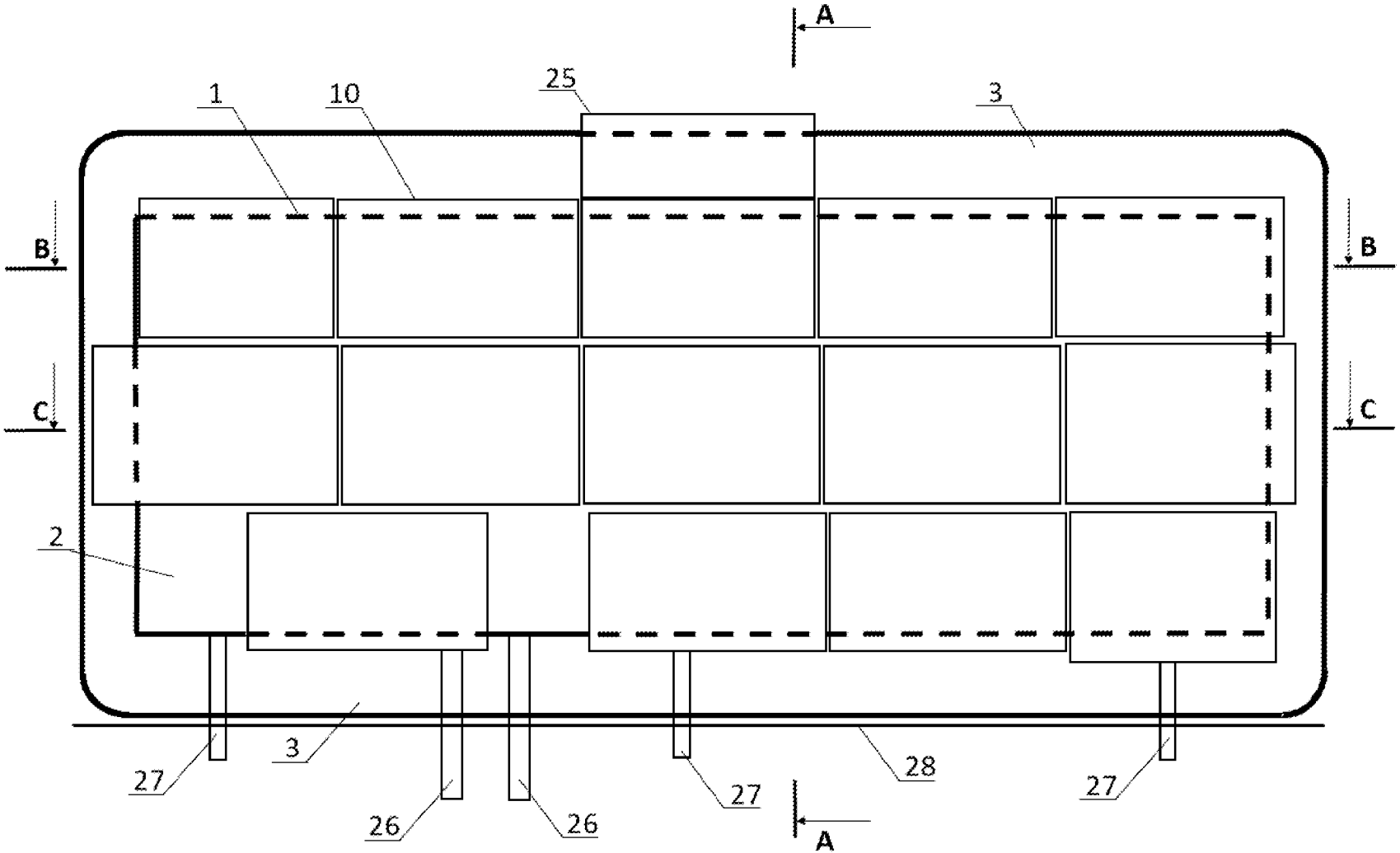

walls that are perpendicular to its external walls and form compartments, some of which are ballast compartments.

4 Claims, 9 Drawing Sheets

(58) Field of Classification Search
USPC ..... 114/264
See application file for complete search history.

(56) References Cited

U.S. PATENT DOCUMENTS

| | | | |
|---|---|---|---|
| 2011/0158750 | A1 | 6/2011 | Reichel et al. |
| 2022/0324541 | A1 | 10/2022 | Kanayama et al. |

FOREIGN PATENT DOCUMENTS

| | | | |
|---|---|---|---|
| GB | 1344938 | A | 1/1974 |
| JP | S58-101915 | A | 6/1983 |
| JP | 2018-028195 | A | 2/2018 |
| KR | 10-2015-0023161 | A | 3/2015 |
| KR | 10-2018-0051852 | A | 5/2018 |
| KR | 10-2020-0048782 | A | 5/2020 |
| RU | 2 467 122 | C1 | 11/2012 |
| WO | 2015/039169 | A1 | 3/2015 |
| WO | 2017/056972 | A1 | 4/2017 |
| WO | 2021/106151 | A1 | 6/2021 |

* cited by examiner

D-D

INTEGRATED PRODUCTION COMPLEX ON A GRAVITY- BASED STRUCTURE (GBS)

CROSS REFERENCE TO RELATED APPLICATIONS

This application is the National Stage of PCT/RU2022/000287 filed on Sep. 22, 2022, which claims priority under 35 U.S.C. § 119 of Russian Application No. 2021129508 filed on Oct. 11, 2021, the disclosure of which is incorporated by reference. The international application under PCT article 21(2) was not published in English.

TECHNICAL FIELD

The invention pertains to production facilities and can be used for creation of production complexes intended for hydrocarbon processing, storage, and offloading of the processed products, natural gas liquefaction plants, ammonia plants, methanol plants, hydrogen plants on gravity-based structures (GBS).

BACKGROUND ART

There are two types of near-shore and offshore hydrocarbon processing plants, for instance natural gas liquefaction plants (LNG plants).

The most common type is LNG plants on pile foundations, on which an equipment and structures of a plant are installed. In a zone of occasion of permafrost soil, a system of soil thermostabilizers is installed to support plant structures in addition to pile foundations. LNG plants are typically located near the shore to be able to ship the products by sea. Among other things, the plant comprises LNG storage tanks and a jetty for offloading LNG also accommodated on pile foundations, with the LNG plant and LNG tanks located on the shore, and the jetty for offloading LNG with necessary process equipment installed in the near-shore waters. The LNG plant, the tanks, and the offloading jetty are interconnected by pipelines mounted on piperacks erected on pile foundations for LNG transfer for offloading to dedicated tankers-gas carriers.

In order to build an LNG plant on a pile foundation, necessary infrastructure to deliver personnel, construction materials and supplies, accommodate construction workers, store the materials, and operate construction equipment, including temporary roads, all the necessary engineering systems and infrastructure facilities, is typically developed on the construction site. If the LNG plant is to be built at a remote field, especially one with extreme environmental conditions, preparation of infrastructure for construction activities is time-consuming and costly.

LNG plants on pile foundations feature the following disadvantages:

- long period of infrastructure development ahead of construction activities,
- soil thermostabilizers costs (for plants located in a zone of occasion of permafrost soil),
- costs to mobilize and demobilize construction personnel, equipment, and machines,
- the need to ensure that large construction teams can stay and work at the construction site, which is often located in a remote and underdeveloped area with extreme environmental conditions,
- costs to ensure that construction materials, LNG plant equipment and supplies can be delivered regularly to the construction site, which often features limited accessibility by transport,

- costs to dismantle construction infrastructure and remediate disturbed lands after construction completion,
- negative impact on the environment due to extensive preparation and construction activities at the LNG plant site.

The other type of design is a LNG plant on a floating base. In this case, the LNG plant is part of a floating installation that produces, treats, and liquefies natural gas, as well as stores and offloads LNG. Floating installations for production, storage, and offloading of LNG (FLNG) are used for offshore gas field developments and is installed directly at the offshore field using anchoring and/or mooring systems. Such floating installations are not used in offshore locations with heavy ice conditions since their reliable positioning necessary to connect to valves on underwater pipes is impossible due to drifting ice.

Use of LNG plants one floating base applications is limited to offshore field development in ice-free seas.

There is also an option of a LNG plant on a GBS. There exists a design solution (WO 2015/039169 A1, publication date: Mar. 26, 2015) wherein a LNG plant, or a regasification installation, or a gas-fired power plant, is mounted on a gravity based structure (GBS) to be installed on a seabed 5 to 200+ km away from a shore where natural water depth is sufficient for tankers-gas carriers to navigate. In this case, the GBS is also used as a berth for the tankers and has one or more LNG storage tank inside. To connect the GBS to the shore, a pipeline is run on the seabed or on a piperack. A topside structure containing process equipment is accommodated on the GBS deck. The GBS deck has a spare space for additional equipment installation in case of production expansion.

This design features the following disadvantages.

Spare space on the GBS deck requires a larger-size structure with its surface area being only partially in use up until the additional equipment is installed. Furthermore, the GBS is not protected from external effects such as ice impact or emergency ship impact.

There exists an offshore LNG production, storage, and offloading facility (KR 20180051852 A, publication date: Apr. 17, 2018) comprising a steel GBS installed on an earlier prepared underbase foundation on a seabed near a shore with the help of solid ballasting, and LNG process equipment installed onto the GBS once it is installed on the seabed. The GBS comprises an outer steel caisson in the form of a box with its lower surface sitting on the foundation prepared on the seabed near the shore; an inner steel caisson in the form of a box with an LNG storage space, installed inside the outer steel caisson with the smallest possible clearance; a top deck mounted on the outer steel caisson; a wall made from a waterproof insulation plate mounted on internal surfaces of the inner steel caisson and the top deck to insulate natural gas; a liquefaction installation and an offloading installation located on the top deck; and a solid ballast filling the space between the outer and the inner caissons to ensure gravity and to be fixed and immobilised after the settlement.

This design features the following disadvantages.

1. The GBS steel body is more prone to corrosion, which makes it less durable.
2. The GBS steel body needs to be significantly thick to withstand ice impacts, meaning greater metal consumption of the structure.
3. The solid ballast makes GBS ballasting/de-ballasting more challenging.
4. The GBS is not protected from external effects such as ice impact or emergency ship impact.

5. Rectangular prism-shaped GBS has large draft when transported to the installation site, which makes transportation through shallow water areas impossible.

A production complex design, which is the closest to the proposed one, features an offshore natural gas processing facility on a gravity-based structure (GBS) (WO2021/106151 A1, publication date: Mar. 6, 2021) comprising a rectangular prism-shaped GBS with a base slab and a top slab, internal vertical walls and an intermediate slab, on which one or more LNG tanks are installed in one compartment, and also a ballast compartment stretching all along the GBS, and topside modules mounted on supports on the top slab. The GBS top slab has a space for LNG pumps to be removed from the tanks for replacement, repair, or maintenance, between the modules or in recesses in the top slab.

The offshore facility features the following disadvantages:

- the rectangular prism-shaped GBS has large draft when transported to the installation site, which makes transportation through shallow water areas impossible;
- GBS ballasting becomes a challenge since there is a long ballasting compartment stretching all along the GBS without any transverse partitions;
- with LNG tanks arranged in a row in the same compartment, it is impossible to use membrane tanks that feature the lowest metal consumption;
- the GBS is not protected from external effects such as ice impact or emergency ship impact;
- if the GBS top slab has recesses to remove the LNG pumps, the LNG tanks will have lower capacity and the top slab design will become more complicated.

SUMMARY OF THE INVENTION

The technical problem resolved with the invention is as follows. In view of increasing percentage of hydrocarbons produced in the Arctic, there is a pressing need to develop a new efficient production complex for hydrocarbon processing adapted to operate in waters with ice conditions in the Arctic.

The proposed solution for the above problem is an integrated production complex on a gravity-based structure (GBS) comprising the gravity-based structure (GBS) and topside modules with process equipment located on it, the GBS has a rectangular top slab, a rectangular base slab, an intermediate horizontal slab, inner vertical walls, at least one compartment with a tank for hydrocarbons and/or respective processed products, and at least one ballast compartment, the GBS top slab has supports on it, on which the topside modules are mounted, and in accordance with the invention the GBS has a central part and a protruding part, with the central part being a rectangular prism with the said top slab, and the GBS protruding part stretching along sides of the central part all around its perimeter and having external vertical walls, the GBS protruding part and the GBS central part share the above-mentioned base slab, with the protruding part being lower in height than the central part, the GBS central part has longitudinal and transverse walls that form compartments, at least one of which accommodate the said tank, and some of which are ballast compartments, and the GBS protruding part has internal walls that are perpendicular to its external walls and form compartments, some of which are ballast compartments.

Furthermore, some of the compartments formed by the longitudinal and transverse walls of the GBS central part can accommodate auxiliary equipment.

The preferable design features longitudinal and transverse walls forming additional ballast compartments between the intermediate horizontal slab and the base slab.

It is also advisable that the said supports for the topside modules be located above intersections of the longitudinal and transverse walls of the GBS central part.

It is also preferable that pipeline and cable communications be installed in a space between the top slab and a bottom of the topside modules.

The technical result achieved by the proposed technical solution is as follows.

The GBS protruding part adds to buoyancy of the GBS and the entire structure, as well as reduces its draft during transportation to the installation site.

Additional ballast compartments in the periphery of the GBS inside the protruding part make it easy to balance GBS, i.e. to settle GBS down on an even keel, without roll and trim.

Increased width of the GBS bottom part adds to stability of the entire structure during its transportation, enabling to install a topside structure of greater height and weight onto GBS.

The GBS protruding part also protects the central part from drifting ice and emergency ship impact.

The protruding part may also serve as a foundation for a jetty.

LIST OF DRAWINGS

FIG. 1 shows a layout of the integrated production complex on a GBS, top view.

Figure 2:
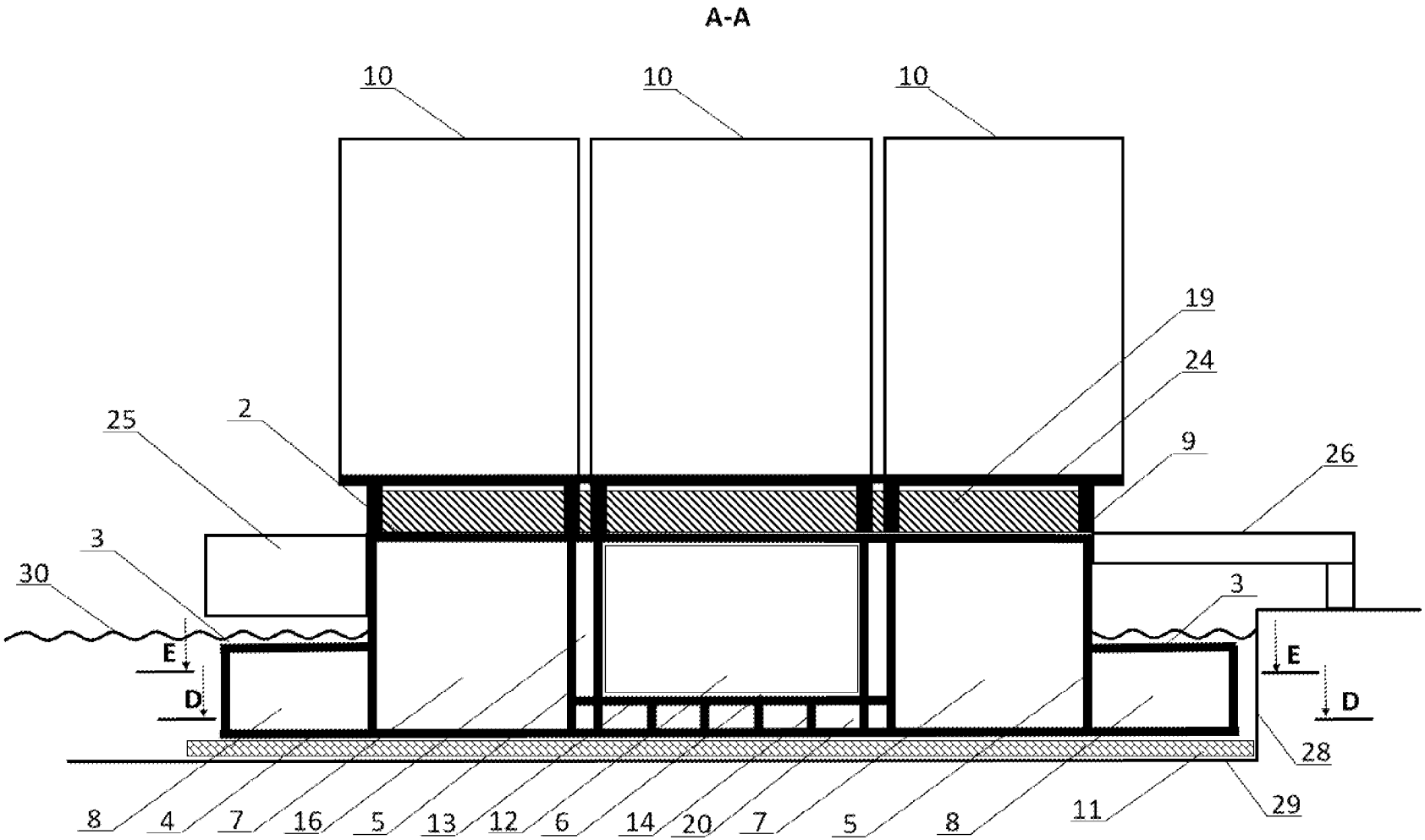

FIG. 2—a transverse section A-A for FIG. 1.

Figure 3:
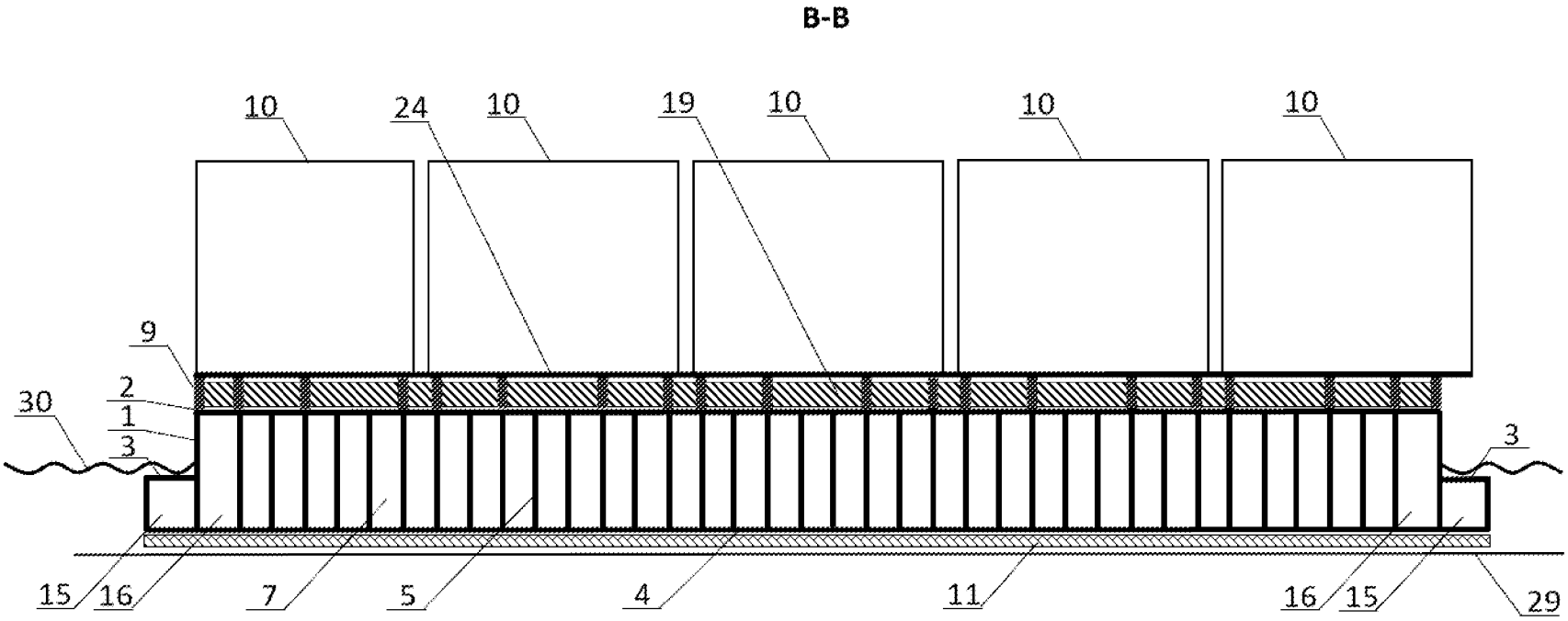

FIG. 3—a longitudinal section B-B for FIG. 1.

Figure 4:
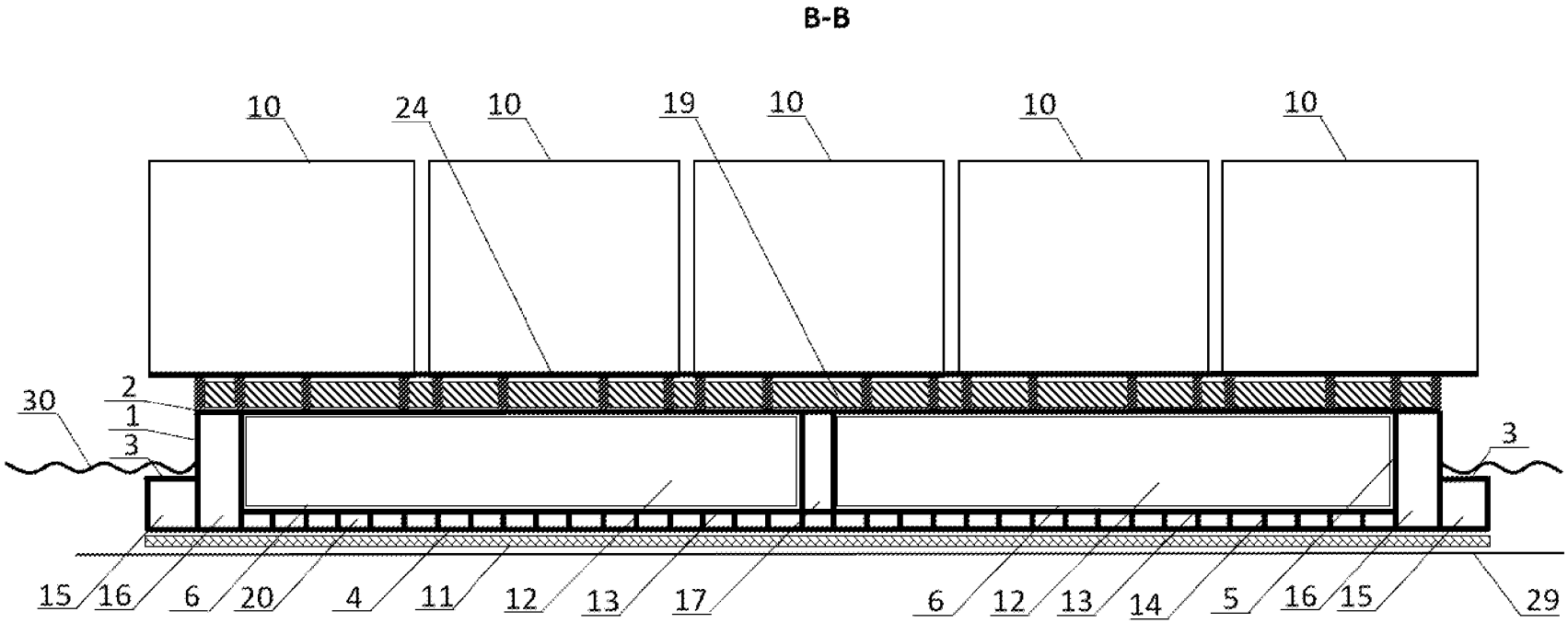

FIG. 4—a longitudinal section C-C for FIG. 1.

Figure 5:
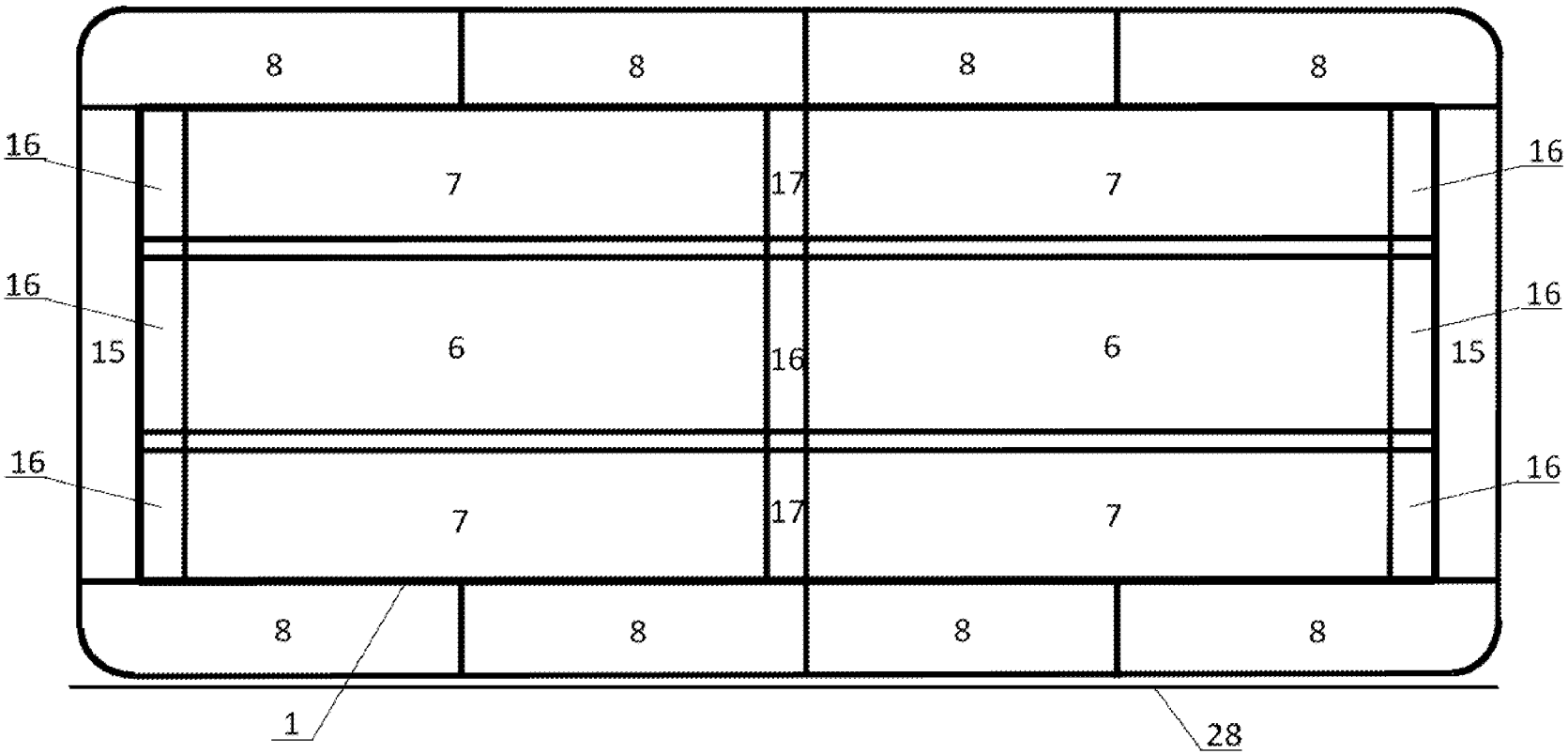

FIG. 5—a layout of the GBS main compartments.

Figure 6:
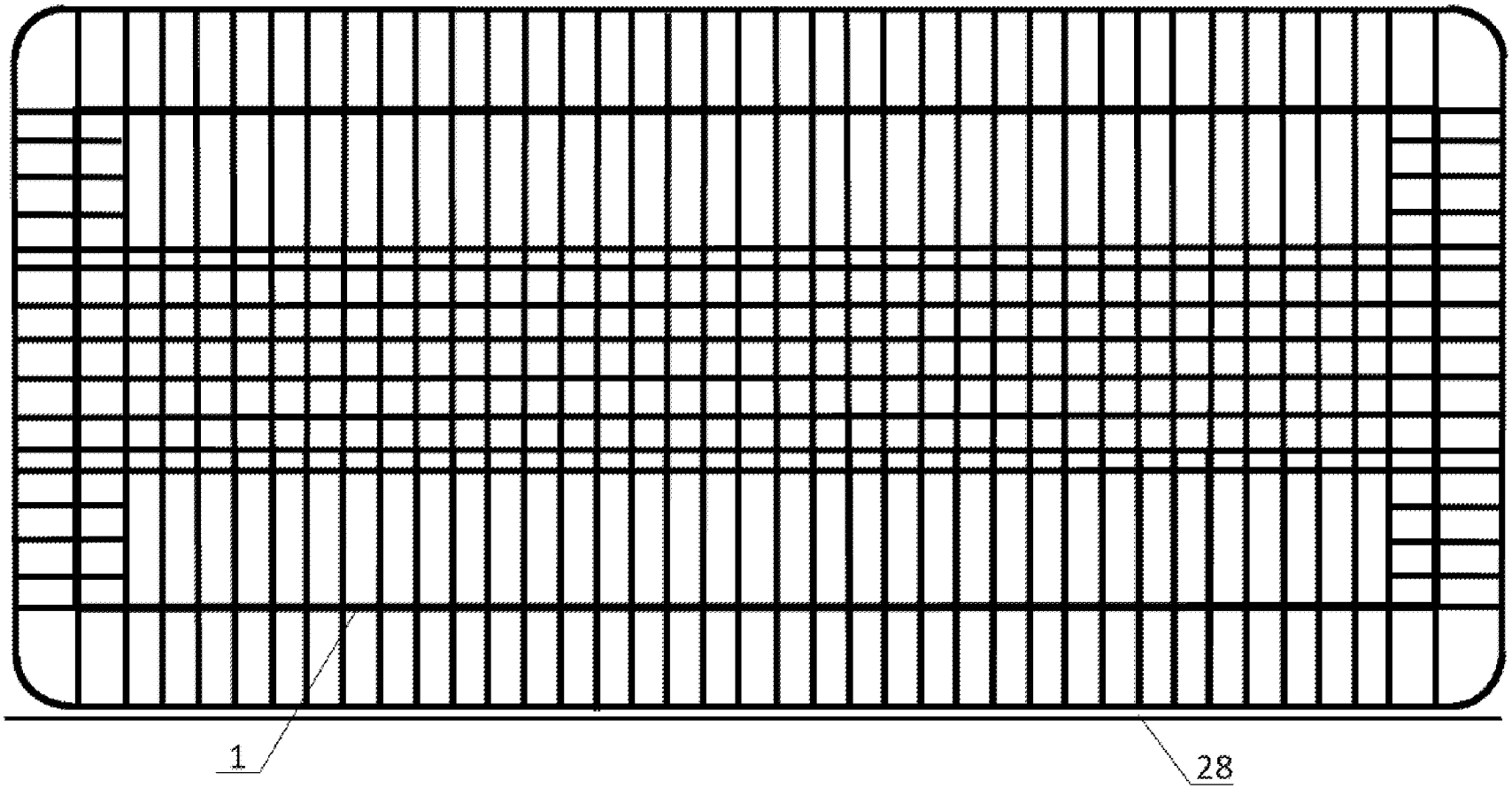

FIG. 6—the vertical walls arrangement in section D-D for FIG. 2.

Figure 7:
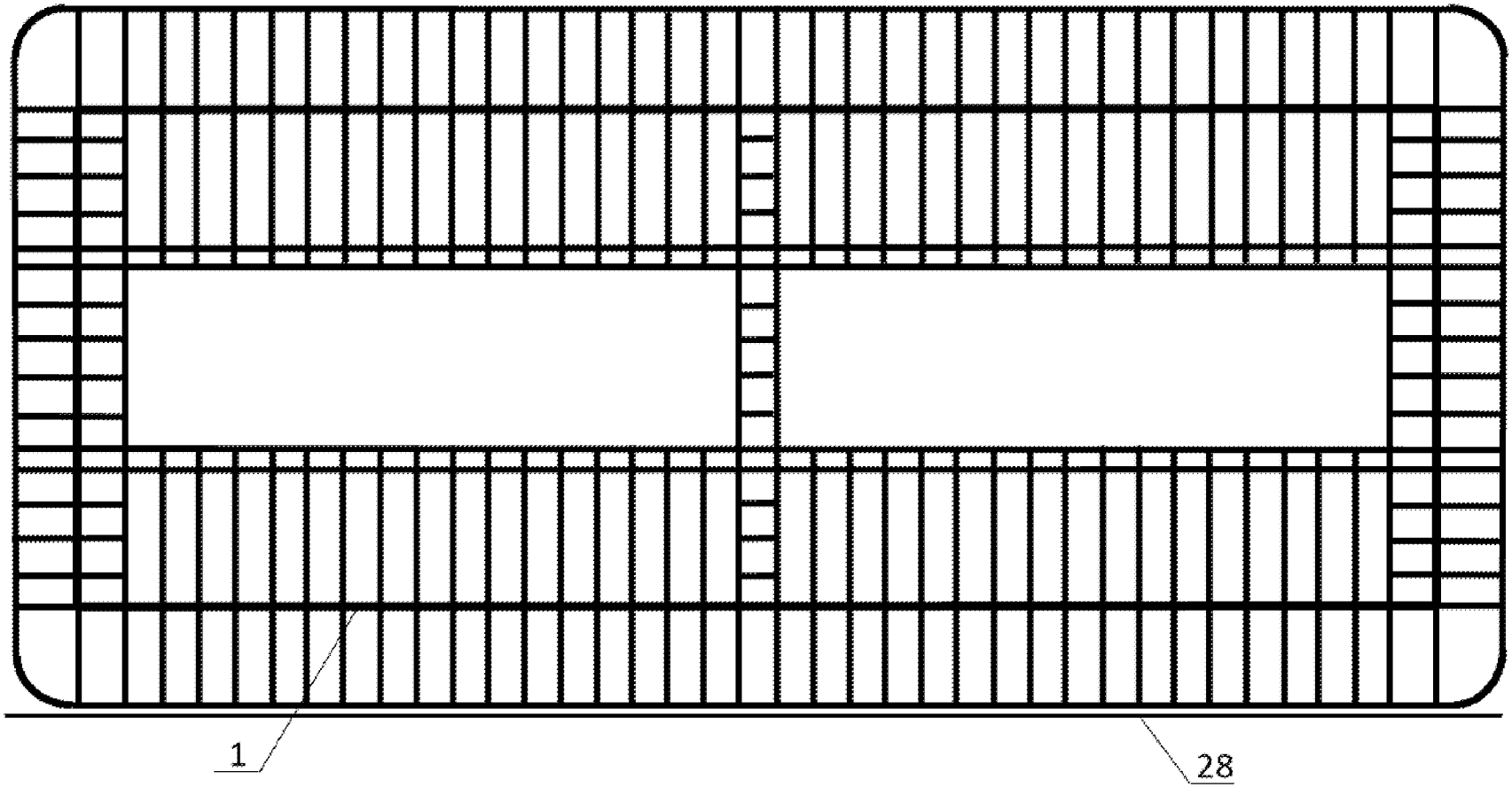

FIG. 7—the vertical walls arrangement in section E-E for FIG. 2.

Figure 8:
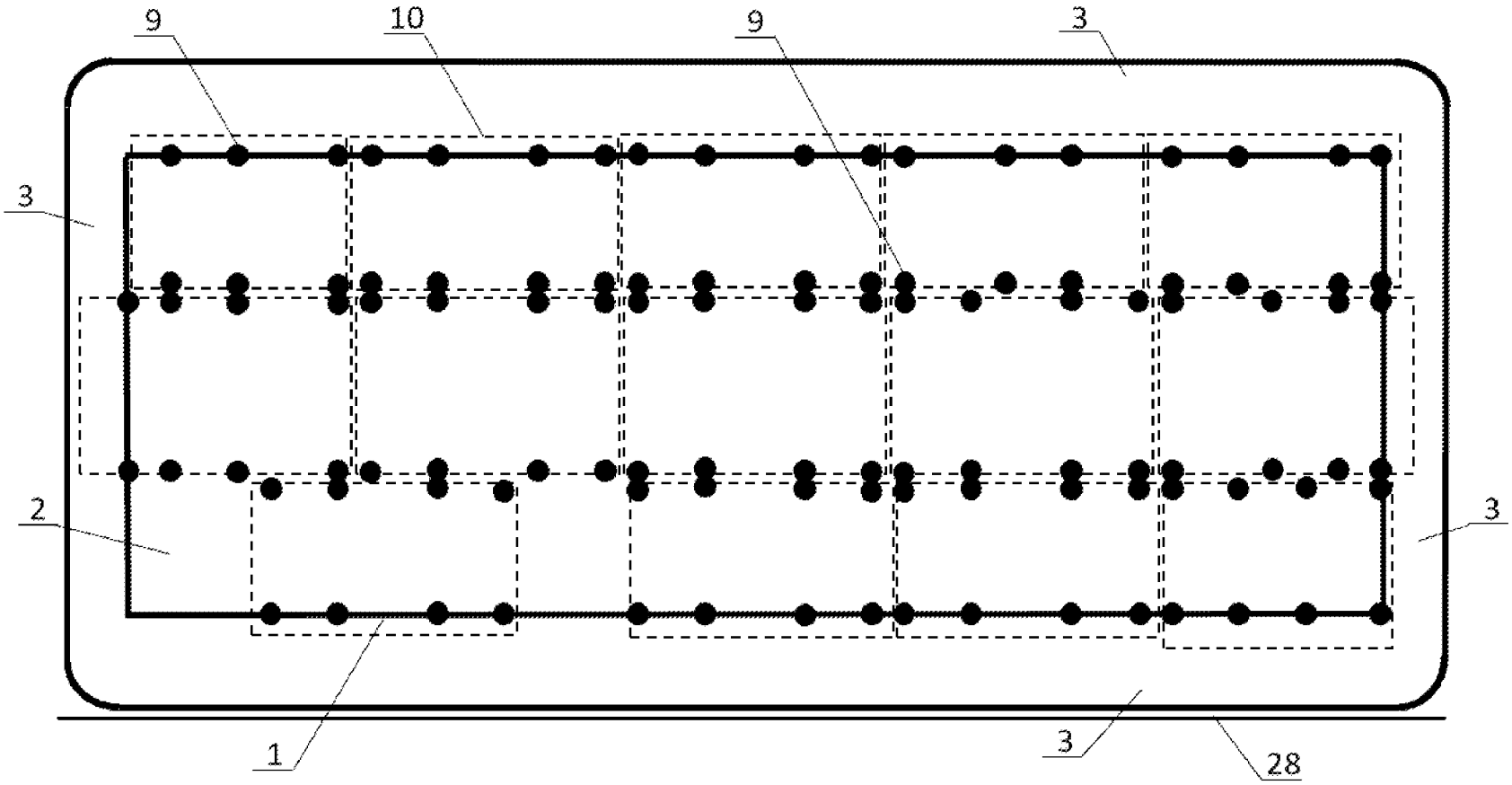

FIG. 8—a layout of the supports of the topside modules on the GBS top slab.

Figure 9:
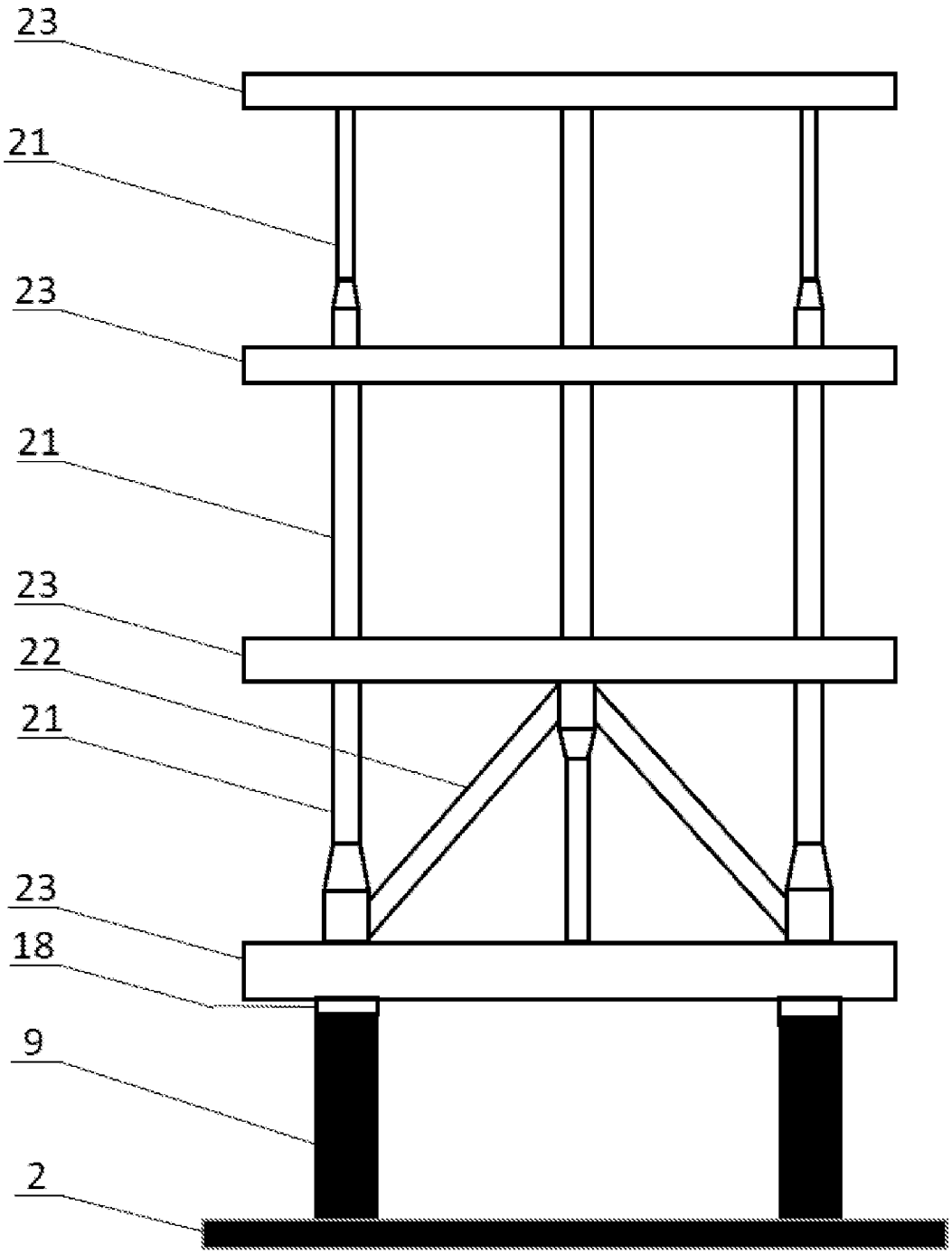

FIG. 9—a layout of the topside bearing structures.

EXAMPLES OF THE INVENTION IMPLEMENTATION

The integrated production complex on a gravity-based structure is a technical product of full technical readiness comprising a set of process, engineering and auxiliary equipment for production, storage and offloading of liquid hydrocarbons or ammonia, power generation, as well as a storage of auxiliary substances and materials. One example of such complex is a liquefied natural gas (LNG) plant.

Integrated GBS production complex is fabricated at a dedicated yard and towed afloat to a place of installation. The GBS is installed on a dedicated underbase foundation of a water body, which can be a sea, lake, river or reservoir. To prevent scouring of the foundation under the GBS and a bed of the water body, fixation of the bed such as gabions or other similar devices may be placed on the bed around the GBS. The GBS is installed near a dedicated quayside and is connected to a shore with racks and bridges, making it possible to lay communications to the shore without using underwater pipelines and/or extensive above-water racks, have easy access to the production complex and a possibility to swiftly evacuate personnel. The racks and bridges reaching the shore are installed after the integrated production complex is installed at the operation site. Located near the shore line, the GBS is integrated with the onshore facilities, including hydrocarbons field being the source of feedstock for the production complex. Before the GBS is installed, the quayside may be used to deliver cargoes, for example, for development of the hydrocarbons field and construction of onshore facilities.

Construction of GBS production complexes will solve challenges caused by the extended and costly works to get prepared for the construction and to build a piled plant, as well as by the fact that it would not be possible to use such plant on a floating structure to develop fields in water areas with ice conditions.

One of options of the proposed integrated GBS production complex could be a power generation unit utilizing thermal energy from natural gas combustion. Such complexes can receive liquefied natural gas (LNG) from specialized tankers—gas carriers, store it, regasify and convert it to power.

The main elements of a production line are the gravity-based structure (GBS) and the topside—modularized process equipment (FIG. 1-4).

The GBS is a solid reinforced-concrete structure serving as a storage for raw materials produced and processed, as well as for auxiliary substances and materials. The GBS is a base for the topside of the production complex and is designed to be installed on the bottom of a water body under its own weight. Central part 1 of the GBS is shaped as a rectangular prism and has top slab 2.

On the sides of central part 1 along the whole perimeter, GBS protruding part 3 with vertical outer walls is located. GBS central part 1 and protruding part 3 have common bottom slab 4, and the height of protruding part 3 is lower than the height of GBS central part 1.

GBS central part 1 is separated into compartments with vertical longitudinal and transversal walls 5 (FIG. 5-7). Some compartments, e.g. compartments 6, are used to store the produced and processed feedstock, while other compartments, e.g. compartments 7, are used to store ballast water. GBS protruding part 3 is separated with vertical walls 5 perpendicular to its outer walls into compartments. Compartments 8 located along the longer sides of the GBS are also included in the ballast system.

GBS top slab 2 has reinforced concrete supports 9 on which topside modules 10 are installed.

The GBS can stay afloat during water transportation to the site of installation of the integrated production complex and can withstand ice impact in ice conditions. Changing the GBS condition from floating to stationary at the site of installation on foundation 11 is ensured by flooding ballast compartments 7, 8 with water.

The GBS outer dimensions may vary depending on the production complex purpose, e.g. for an LNG plant the GBS dimensions (including the protruding part 3) may be as follows: length 324 m, width 154 m, height 30.2 m. In this case the length of the GBS central part 1 is 300 m, the width is 108 m, the height is 30.2 m. The protruding part 3 on the sides of the GBS has the width of 22 m, on the short-end walls of the GBS—12 m. The height of protruding part 3 is 13.75 m.

The main space-planning solutions of the GBS structures are defined by technological parameters, as well as internal and external loads affecting the GBS structure, taking into account their maximum possible negative combination.

The GBS central part 1 is rectangular prism-shaped and includes the main bearing structures, i.e. the vertical longitudinal and transversal walls 5 and horizontal slabs: top slab 2, base slab 4, and intermediate support slab 13 under main tanks 12 for the storage of hydrocarbons and/or respective processed products. The bearing structures ensure the required spatial stiffness of the cage of the GBS, including during transportation of the integrated production complex and it being afloat until it is installed. Reinforced-concrete walls also provide partition the GBS into compartments in accordance with their functional purpose. Some of transverse walls 5 may have a rectangular opening in their central part instead of being solid. In this case they essentially serve the purpose of stiffening ribs.

Reinforced-concrete walls also serve as bearing structures that transfer the load from the topside to support slab 13 and foundation 11, that is why topside supports 9 are located above the intersections of vertical longitudinal and transversal walls 5 of the GBS.

Top slab 2 of the GBS has slopes from the central longitudinal line to the edges for drainage of atmospheric precipitation and process spills. The structure of top slab 2 is designed to withstand explosion loads in case of emergency situations. In case cryogenic liquids are involved in the technological process, in order to protect top slab 2 from spillage of cryogenic media, steel with enhanced cold resistance characteristics is used as reinforcement.

Horizontal support slab 13 is provided between top and base slabs 2 and 4 to distribute the loads from liquid hydrocarbons and/or respective processed products storage tank 12. Longitudinal and transverse walls 14 under said slab 13 transfer the load to base slab 4 and ensure the spatial stiffness of the structure.

Reinforced concrete based on modified normal density concrete with tensioned reinforcement is the main material of GBS central part 1.

GBS protruding part 3 is located along the perimeter of GBS central part 1, forming a single structure with it. Long sides of protruding part 3 mostly house ballast compartments 8 (FIG. 5), while the short-end sides mostly house auxiliary and engineering compartments 15. GBS protruding part 3 serves the following main purposes:

- achieving the required target GBS buoyancy parameters;
- housing ballast compartments 8 mostly intended for the GBS balancing, ensuring the GBS being afloat with an even keel, without roll and trim;
- forming a natural protective barrier in case of design emergency collision/ship impact; protruding part 3 will absorb and dissipate most of the collision's energy, preventing damage to the main part of the GBS cage ensuring the integrity and preservation of main tanks 12 and bearing structures of the topside foundation;
- housing auxiliary process and marine equipment ensuring LNG tankers mooring and offloading of liquid hydrocarbons.

Storage tanks for liquid hydrocarbons and/or respective processed products are accommodated in the GBS compartments and intended for storage of products of the integrated production complex. Depending on its intended use, the production complex may also have storage tanks for feedstock, semi-processed products, and consumables. GBS central part 1 has a number of tanks 12 (FIG. 5) that may have different design depending on the properties of substances to be stored. For storage of LNG and cryogenic liquids under pressure close to atmospheric, membrane tanks are used. In this case, tank 12 consisting of a steel membrane made of stainless steel or invar (Fe—Ni alloy) separated from concrete structure by a thermal insulation layer is installed inside concrete compartment 6. The thermal insulation layer is located directly on top slab 2, intermediate slab 13 and GBS walls, transferring the loads from tank 12 and its liquid content to the above-mentioned boundary structures. The GBS slabs and walls thus serve as support structures for membrane tanks, with which they are integrated into a single structural unit. To prevent any leaks, the bottom and the side surfaces of membrane tanks 12 have a secondary barrier being an additional membrane installed inside the thermal insulation layer.

In case of an LNG plant, liquefied gas is stored in two 115,000-cbm tanks 12, each installed in a 135×40×24 m individual compartment 6. Compartments 6 with tanks 12 are surrounded by dry compartments 16 enabling inspections of external surfaces of the tanks boundary structures.

For storage of condensate and other liquid hydrocarbons that do not require low temperatures, GBS concrete compartments 17 may be used, with their boundary structures serving as a protective barrier. Some of compartments 7 can be used both for ballast water and for storage of condensate and other liquid hydrocarbons that do not require low temperatures. In case of an LNG plant, there is 75,000-cbm 135×30×30 m compartment 7 for stable condensate storage and one of compartments 17 for substandard condensate storage with a capacity of 5,000 cbm and 30×8×30 m in size.

"Wet" storage involving an underlying water layer may be used for hydrocarbons that are less dense than water. In this case, the bottom layer of the stored product around 1 m in thickness is considered a commingling area ensuring guaranteed separation of water and the stored product during loading operations. Compartment 7 is also slightly pressurized (from the atmospheric pressure level) using a nitrogen blanket in the upper part of the compartment 7 to air-proof compartment 7 and prevent any flammable and explosive gas mixtures with hydrocarbon vapors from forming.

The height of the underlying water layer in compartment 7 may be fixed or variable. In case of the former, the height of the underlying water layer is fixed, e.g. at two meters, irrespective of the quantity of condensate or other liquid hydrocarbons stored in the compartment. The change of the condensate volume in compartment 7 is compensated by the change of the volume of the nitrogen blanket. In the latter case, the height of the underlying water layer changes for compartment 7 to be permanently filled with liquid. As compartment 7 is filled with condensate or other liquid hydrocarbons, part of water is removed from it with active ballast system. When the level of hydrocarbons stored decreases, additional water is fed to compartment 7.

Compartments 6 for storage of large volumes of hydrocarbons are located in GBS central part 1. Smaller compartments as tanks (for example, for diesel fuel, hot oil or glycol water) could also be located in protruding part 3 of GBS.

To store small volumes, self-supported tanks are also used in GBS compartments (in central part 1 or in protruding part 3). In case of LNG plant, self-supported tanks are used for waste water, demineralized water, fresh water, wash water, absorber, butane and propane.

Auxiliary and engineering compartments 16 in GBS central part 1 are located to the sides of main hydrocarbon storage compartments 6 and in the center between them. Said compartments 16 are intended for process needs, placement of equipment, tanks of process fluids, as well as access and evacuation routes for personnel. With dry compartments 16 along the perimeter of main compartments 6 for hydrocarbons storage, external surfaces of the boundary walls of tanks 12 for hydrocarbons storage can be inspected.

Auxiliary and engineering compartments 15 are located in protruding part 3 of the GBS. Said compartments 15 are intended for process needs, placement of equipment and tanks of process fluids.

The engineering equipment includes: power supply system, including substations; heating, ventilation and air conditioning (HVAC) systems; a ballast water heating and recirculation system; water supply and disposal systems; firewater pumps and pipelines; foam fire-fighting system skids; an electrochemical protection system; telecommunication and alarm systems and video surveillance system. Most of the engineering equipment is located on top slab 2 and/or on modules 10, while the rest—in engineering compartments 15. Auxiliary compartments 15 could be left empty, with ladders and manholes for accessing the interior.

Supports 9 of the topside modules on GBS top slab 2 ensure that support reactions are transferred on the main load-bearing structures of the GBS from topside modules 10. Structurally, the supports are reinforced-concrete pylons with heads for embedded components. At GBS supports 9 and topside modules 10 connection points, special sealings 18 are used (FIG. 9) to ensure free rotation and movement in predetermined directions to compensate thermal expansion of topside modules 10.

Location of supports 9 on the layout (FIG. 8) is defined basing on crossing of GBS load-bearing walls 5 to ensure distribution of loads from topside modules 10.

The height of supports 9 is selected so as to provide enough space 19 between GBS top slab 2 and a lower part of topside modules 10 to place piping and cable communications between the topside and equipment in the GBS compartments and for people and machinery to be able to move on GBS top slab 2.

The GBS ballast system includes internal ballast compartments 7, internal ballast compartments 20 under support slab 13, formed by vertical walls 14, as well as external ballast compartments 8 located in GBS central part 1 and in GBS protruding part 3. The ballast recirculation and heating system is provided to prevent freezing of water in the ballast compartments.

The water in the ballast compartments is heated using waste heat from exhaust gas of gas turbines installed on topside modules 10.

The ballast system performs two main functions:

- ballasting, i.e. changing the weight of the GBS, ensuring the required GBS draft when afloat and the structure stability once the GBS is installed on the underbase foundation;
- GBS balancing, i.e. bringing the GBS on an even keel, without roll and trim when afloat, through compensation with ballast water for the structure centre of gravity deviation from its geometric center.

The topside on which process equipment is located is composed of modules 10. The number of modules 10 is decided upon during the production complex engineering phase. Location of the modules on the GBS is assumed taking into account their weight to make sure the centre of gravity of the production complex being close to the geometric center of the GBS so as to reduce the volume of ballast water required to balance out the structure when afloat.

Topside modules 10 are three-dimensional steel frames with bracings, which accommodate process equipment, electrical equipment, automation systems, etc.

Vertical columns 21, vertical ties 22 and floor beams 23 are the main elements of the frames with bracings of module 10 (FIG. 9). At a fundamental level, topside modules 10 are not different from topside modules used in the oil & gas sector in terms of their design and layout.

The equipment configuration depends on the purpose of the integrated production complex. For example, at an LNG plant, modules 10 include raw gas treatment units, equipment for gas liquefaction and LNG offloading to tankers-gas carriers, as well as auxiliary equipment and utility lines.

For ease of equipment maintenance and personnel access, each module 10 has several decks. Main tier 24 of each module 10 is at the same height to enable combining evacuation routs and load handling routs across the topside, thus reducing the load on GBS top slab 2. Other tiers of the topside modules 10 vary in height depending on their function and equipment.

Liquid hydrocarbon offloading jetty 25 is structurally integrated with the GBS and the topside. Fenders and an offloading platform with loading arms as well as other marine and process equipment enabling liquid hydrocarbon offloading are installed on the protruding part 3 on the seaward side of the GBS. Mooring equipment for tanker berthing is installed on the topside seaward side.

Jetty 25 can also be used to discharge liquid hydrocarbons from a tanker. If the production complex on a gravity-based structure is a power generation facility, the jetty main function is to receive LNG from tankers-gas carriers.

Division of the GBS to compartments depends on its functional design, including specialization of the integrated production complex. In general, the GBS is designed to have three types of compartments—ballast compartments, hydrocarbon storage compartments, auxiliary and engineering compartments.

In case of a GBS LNG plant, GBS central part 1 comprises six main compartments (FIG. 5). Two compartments 6 along the GBS centerline are intended for hydrocarbon storage, four side compartments 7 can both be used as ballast compartments and additional storage compartments for hydrocarbons, e.g. condensate. In case of "wet" storage of hydrocarbons with variable water level, compartments 7 are both ballast compartments and storage compartments for hydrocarbons and/or respective processed products. The auxiliary and engineering compartments 16 as well as additional hydrocarbon storage compartments 17 are located between the main compartments 6, 7.

Additional ballast compartments 20 (FIG. 2, FIG. 4) are located under main hydrocarbon storage compartments 6 between base slab 4 and support slab 13 for main hydrocarbon storage tanks 6, 7.

GBS protruding part 3 (FIG. 5) accommodates ballast compartments 8 and auxiliary and engineering compartments 15. In case of GBS LNG plant, protruding part 3 on the sides comprises mostly ballast compartments 8 while on the short ends it comprises mostly auxiliary and engineering compartments 15. Seabed 29 and water level 30 in the body of water are shown on FIG. 2 to 4.

Compartments may be separated by transverse partitions, except for main LNG storage compartments 6. In this case, openings are made inside the ballast compartments for ballast water to flow through, and passages for personnel and penetrations for communications are made in the auxiliary and engineering compartments.

The integrated production complex on a gravity-based structure is connected to the shore by two piperacks 26, in which piping and cabling are laid, as well as three evacuation bridges 27 for personnel movement and evacuation, when needed. The piperacks and bridges are made as steel bridge structures mounted on supports. Said supports are located on GBS top slab 2 on one end, and on quayside 28 on the other.

The invention claimed is:

1. A production complex for hydrocarbon processing which comprises a gravity-based structure and topside modules with process equipment located on it, the gravity-based structure has a central part and a protruding part, with the central part having form of a rectangular parallelepiped with a top slab and an intermediate support slab, and the protruding part stretching along the central part sides all around a perimeter of the central part and having external vertical walls, the protruding part and central part share a base slab, with the protruding part being lower in height than the central part, the central part has longitudinal and transverse vertical walls that form compartments, some of which are compartments to store hydrocarbons and/or processed product, and some of which are first ballast compartments, some of the compartments to store hydrocarbons accommodating tanks are located on the intermediate support slab, each of some compartments of the central part, including the compartments to store hydrocarbons and/or processed product and the first ballast compartments, are located on both sides of the support slab and extend from the base slab to the top slab, and there are additional longitudinal and transverse walls forming second ballast compartments between the intermediate support slab and the base slab, besides the protruding part has internal walls that are perpendicular to its external walls and form compartments, some of which are third ballast compartments.

2. The production complex according to claim 1, wherein some of the compartments formed by the central part longitudinal and transverse walls accommodate auxiliary equipment.

3. The production complex according to claim 1, wherein the top slab has supports, on which the topside modules are mounted, and the supports are located above intersections of the longitudinal and transverse walls of the central part.

4. The production complex according to claim 3, wherein piping and cabling are located in the space between the top slab and lower parts of the topside modules.

* * * * *